US005570967A

United States Patent [19]

Chen

[11] Patent Number: 5,570,967

[45] Date of Patent: Nov. 5, 1996

[54] WRITING INSTRUMENT HAVING LIGHT DEVICE

[76] Inventor: Chuang-Yi Chen, 3rd Floor, No. 192, Section 4, Chen Deh Road, Taipei, Taiwan

[21] Appl. No.: 502,486

[22] Filed: Jul. 14, 1995

[51] Int. Cl.[6] ..... B43K 29/10

[52] U.S. Cl. ..... 401/195; 362/118

[58] Field of Search ..... 362/118; 401/195

[56] References Cited

U.S. PATENT DOCUMENTS

| | | | |
|---|---|---|---|
| 3,122,328 | 2/1964 | Weber | 362/118 |
| 5,131,775 | 7/1992 | Chen | 362/118 X |
| 5,275,497 | 1/1994 | Shiau | 362/118 X |
| 5,405,208 | 4/1995 | Hsieh | 362/118 X |
| 5,470,164 | 11/1995 | Chen | 362/118 X |

FOREIGN PATENT DOCUMENTS

| | | | |
|---|---|---|---|
| 584738 | 10/1959 | Canada | 362/118 |
| 616958 | 2/1961 | Italy | 362/118 |
| 2273268 | 6/1994 | United Kingdom | 362/118 |

*Primary Examiner*—Steven A. Bratlie
*Attorney, Agent, or Firm*—Connolly & Hutz

[57] ABSTRACT

A writing instrument includes a tube having a cap secured to the lower portion and having a light element engaged in the cap. A pipe is slidably engaged in the tube and engaged on a writing element. A barrel is secured in the tube and a housing is slidably engaged in the upper portion of the tube. An insulating sleeve is engaged in the housing for receiving a battery and has a knob engaged on top. The knob is electrically connected to the housing for energizing the light element and is disengaged from the housing for turning off the light element.

1 Claim, 5 Drawing Sheets

WRITING INSTRUMENT HAVING LIGHT DEVICE

BACKGROUND OF THE INVENTION

1. Field of the Invention

The present invention relates to a writing instrument, and more particularly to a writing instrument having a light device.

2. Description of the Prior Art

Typical writing instruments, particularly the twist type retractable writing instruments comprise a writing element that may be retracted within a pen body or may be extended outward of the pen body for writing purposes. However, the typical writing instruments include no light devices for lighting purposes. It is inconvenient to write in the dark where no light devices are available.

The present invention is provided to obviate the afore-described disadvantages of the conventional writing instruments.

SUMMARY OF THE INVENTION

The primary objective of the present invention is to provide a writing instrument having a light device for lighting purposes.

In accordance with one aspect of the invention, there is provided a writing instrument comprising a tube including an upper portion and including a lower portion, a cap secured to the lower portion of the tube, a light element engaged in the cap and including a first electrode and a second electrode, a writing element slidably engaged in the tube, means for energizing the light element, and knob means for moving the writing element partially outward of the tube and for electrically connecting the case electrode of the batteries to the housing.

A pipe is slidably engaged in the tube and includes a lower portion engaged with the writing element and includes an upper portion. A barrel is secured in the tube. A housing is slidably engaged in the upper portion of the tube and electrically connected to the tube. A first cable electrically connects the tube to the first electrode of the light element. An insulating sleeve is engaged in the housing. At least one battery is engaged in the sleeve and includes A case electrode and a center electrode, a knob is threadedly engaged on top of the sleeve. Cable means electrically connects the knob to the case electrode of the battery, and means electrically connects the center electrode to the pipe and the writing element. A second cable electrically connects the writing element to the second electrode of the light element. The light element is energized when the knob is rotated relative to the sleeve to engage with the housing, and the light element is not energized when the knob is rotated relative to the sleeve to disengage from the housing.

A circuit board is engaged in the cap and includes an outer peripheral portion and includes an orifice having an inner peripheral surface, the first cable electrically connects the first electrode of the light element to the outer peripheral portion of the circuit board, the second cable electrically connects the second electrode of the light element to the inner peripheral surface. The writing element is engaged through the orifice of the circuit board for electrically and slidably contacting with the second cable.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
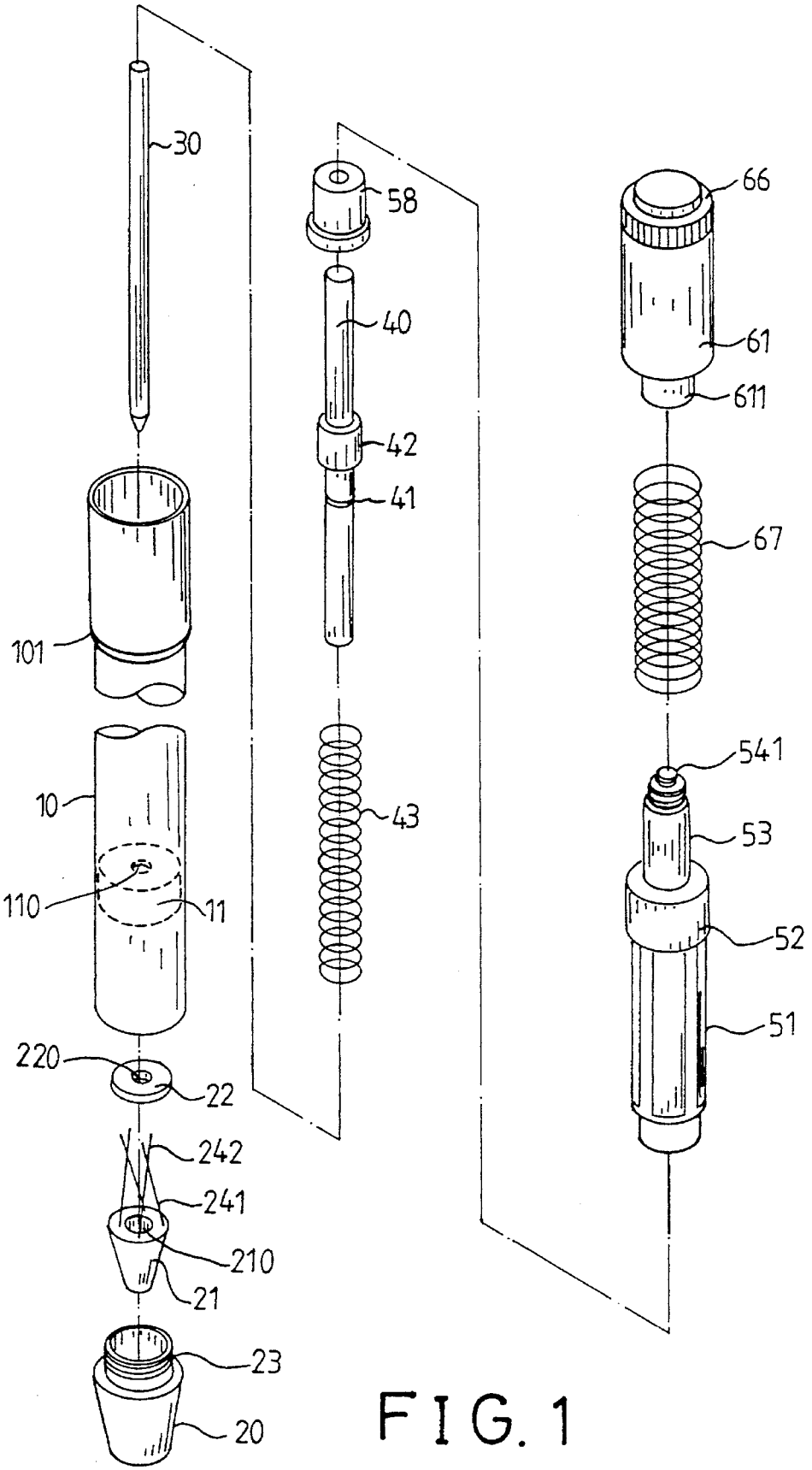
FIG. 1 is a partial exploded view of a writing instrument in accordance with the present invention.

Referring to the drawings, and initially to FIGS. 1 to 4, a writing instrument in accordance with the present invention comprises a tube 10 including an annular shoulder 101 formed in the upper portion and including a collar 11 engaged in the lower portion. The collar 11 includes an orifice 110 having a tapered upper end and having a tapered lower end for engaging with a writing element 30. The tube 10 includes an inner thread 100 formed in the lower end (FIGS. 5 to 8) for threadedly engaging with an outer thread 23 of a lower cap 20. A light element, such as a light bulb or a light-emitting diode (abbreviated as LED) 21 is secured in the lower cap 20 and includes a frustoconical shape having a hole 210 formed therein for engaging with the writing element 30. A circuit board 22, or a ring element of insulating materials is secured in top of the cap 20 and includes an orifice 220 formed therein. Two cables 241, 242 electrically connect the two electrodes of the light element 21 to the outer peripheral portion and to the inner peripheral portion of the orifice 220 respectively for electrically connecting to the cap 20 and the tube 10 and to the writing element 30 respectively, best shown in FIGS. 5 to 8. The writing element is of conventional construction and may be different colored ink ball or other point cartridges.

A pipe 40 is engaged in the tube 10 and includes an annular swelling 42 formed on the middle portion and includes an annular rib 41 located below the annular swelling 42 and extended radially inward of the pipe 40 for engaging with the writing element 30. A spring 43 is engaged between the annular swelling 42 of the pipe 40 and the collar 11 for biasing the pipe 40 upward of the tube 10.

Figure 2:
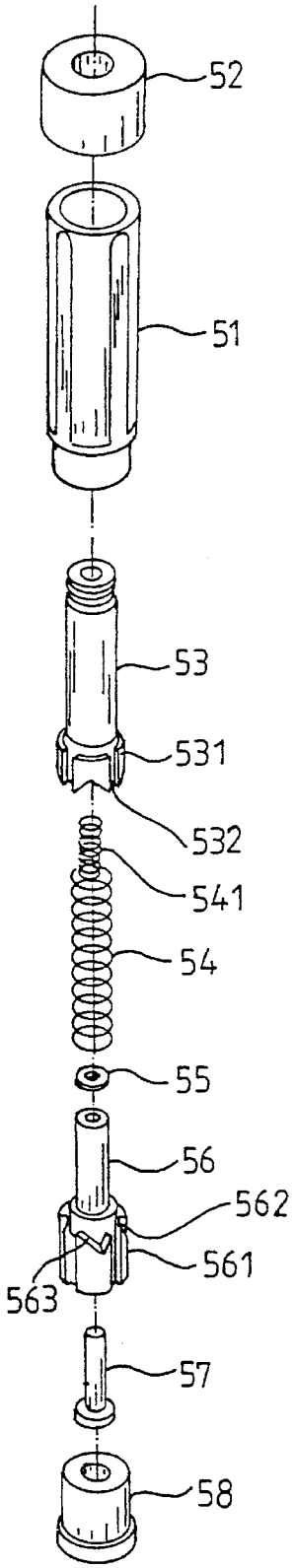
FIG. 2 is a partial exploded view showing a twist mechanism of the writing instrument.
Figure 5:
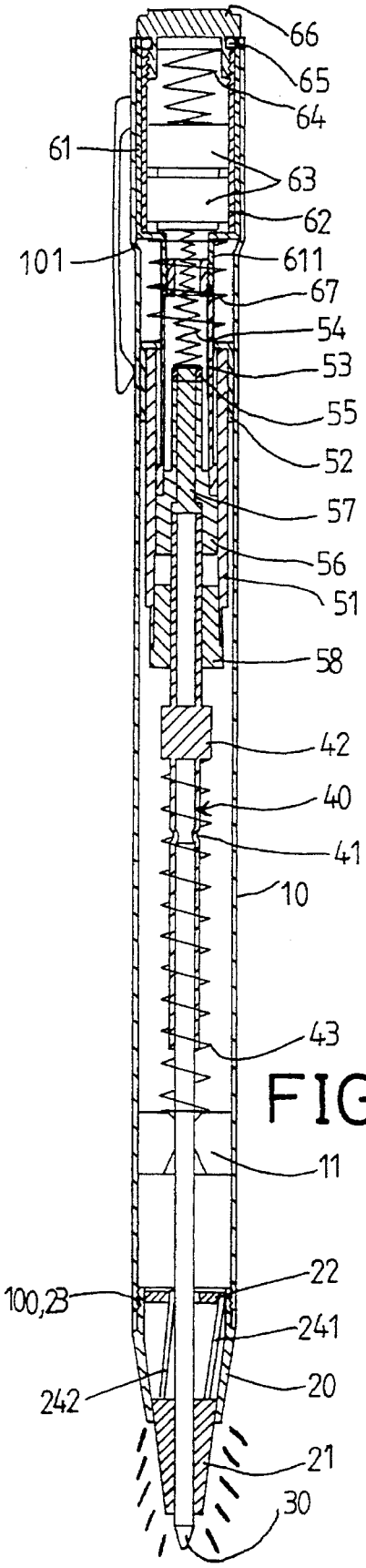
FIGS. 5, 6, 7, 8 are cross sectional views of the writing instrument, illustrating the operation of the writing instrument.
Figure 6:
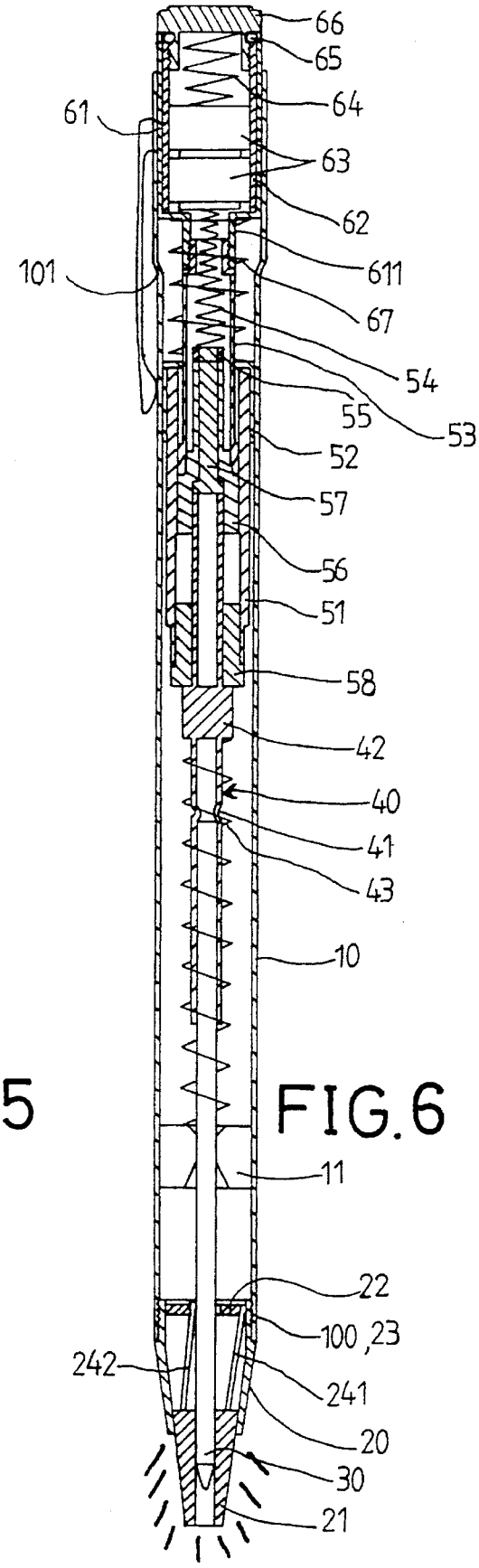
Figure 7:
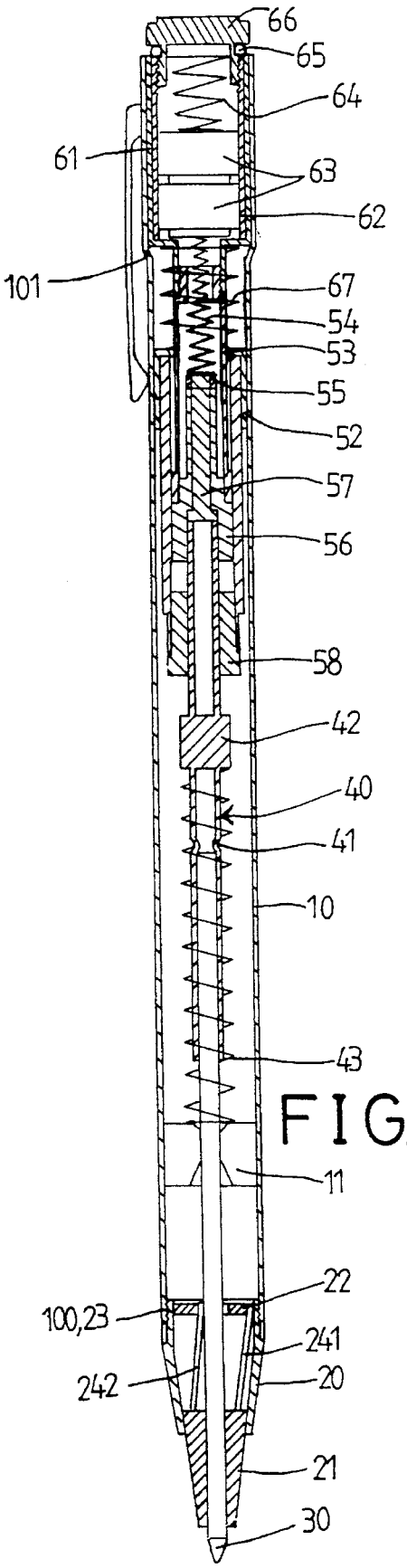
Figure 8:
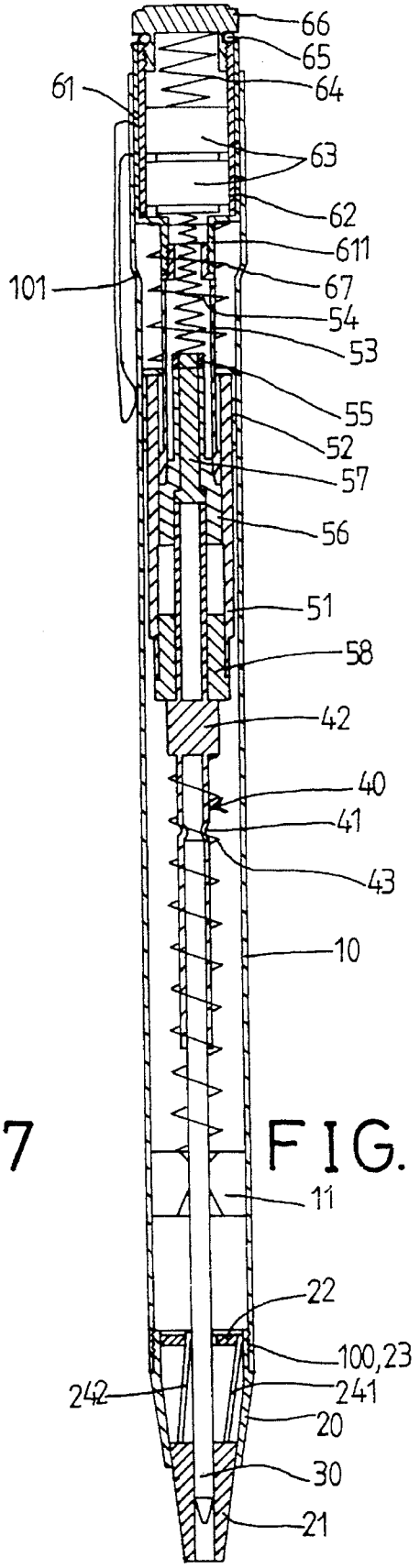

As shown in FIG. 2, a barrel 51 is engaged in the tube 10 and includes a cover 52 secured on top thereof and force-fitted in the tube 10. A post 53 is slidably engaged in the barrel 51 and includes an upper portion extended upward through the cover 52. The post 53 includes a lower portion 531 having a number of projections 532 extended downward therefrom similar to that of the typical twist type retractable pen. A spring 54 is engaged in the post 53 and includes an upper portion 541 of reduced diameter extended slightly upward beyond the post 53, best shown in FIG. 1. A washer 55 is engaged on the bottom end of the spring 54. A follower 56 has an upper portion slidably engaged in the post 53 and includes an upper end engaged with the washer 55 and includes a block 561 formed on the lower portion. The block 561 includes a number of recesses 562, 563 of different depths formed in the upper portion for engaging with a number of engaging ribs (not shown) which are formed in the inner peripheral portion of the barrel 51. The engagement of the engaging ribs with the recesses 562, 563 of different depths may control the relative positions between the post 53 and the follower 56. For example, when the engaging ribs are engaged with the recesses 562 of smaller depth, the block 561 may be located closer to the post 53 (FIGS. 6 and 8). However, when the engaging ribs are engaged with the recesses 563 of larger depth, the block 561 may be separated from the post 53 for a longer distance (FIGS. 5 and 7). The configuration and the engagement of the engaging ribs and the block and post are not related to the present invention and are commercially available and will not be described in further details. A pin element 57 is engaged in the follower 56 and is engaged with the upper end of the pipe 40. A stop 58 is secured in the lower end of the barrel 51 and engaged with the annular swelling 42 of the pipe 40.

Figure 3:
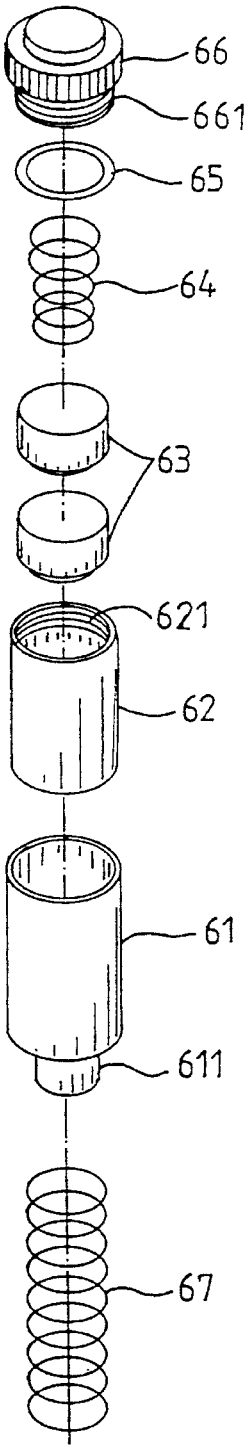
FIG. 3 is a partial exploded view showing a casing for accommodating the batteries.
Figure 4:
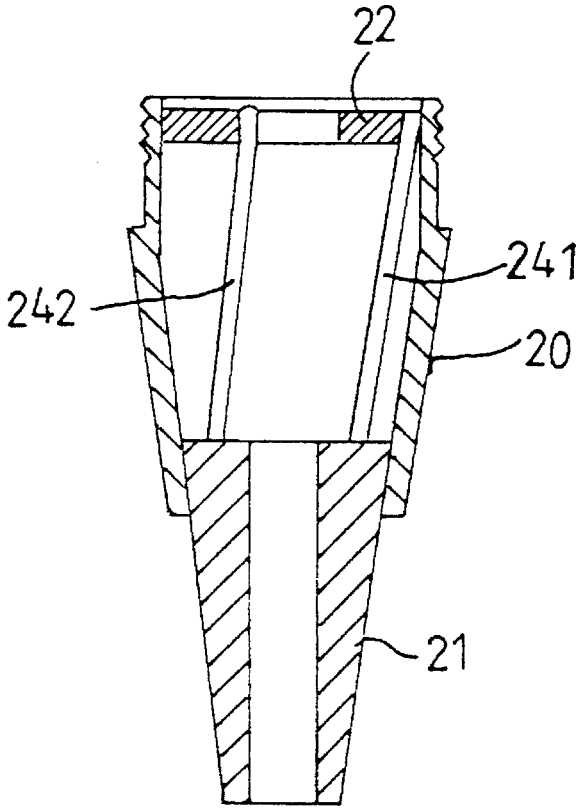
FIG. 4 is a partial cross sectional view of the writing instrument, illustrating the light device of the writing instrument.

As shown in FIG. 3, a housing 61 is slidably engaged in the upper portion of the tube 10 and includes an extension 611 extended downward and threadedly engaged with the upper end of the post 53 such that the housing 61 and the post 53 move in concert. A spring 67 is engaged between the housing 61 and the cover 52 for making an electric connection between the housing 61 and the cover 52 and the barrel 51. A sleeve 62 of insulator materials is engaged in the housing 61 for receiving one or more batteries 63. The sleeve 62 includes an inner thread 621 formed in the upper portion for engaging with an outer thread 661 of a knob 66. A sealing ring 65 is engaged between the knob 66 and the housing 61 and a spring 64 electrically connects the case electrode of the batteries 63 to the knob 66. The knob 66 may be rotated relative to the sleeve 62 in one direction so as to electrically engage with the housing 61, and may be disengaged from the housing 61 when rotated relative to the sleeve 62 in a reverse direction. The center electrode of the batteries 63 is electrically contacted with the spring 54 and the washer 55 and the follower 56 and the pin 57 and the pipe 40 and the writing element 30.

Referring next to FIGS. 5 and 6, in operation, the knob 66 is rotated relative to the sleeve 62 to engage with the housing 61 so as to electrically connect the case electrode of the batteries 63 to the housing 61 and the tube 10. The tube 10 is electrically connected to the light element 21 via the cap 20 and the cable 241. The other electrode of the light element 21 is electrically connected to the cable 242 and the writing element 30 and the pipe 40 and the pin 57 and the washer 55 and the spring 54 and connected to the center electrode of the batteries 63. At this moment, the light element 21 is energized by the batteries 63 and may emit lights.

However, as shown in FIGS. 7 and 8, when the knob 66 is rotated relative to the sleeve 62 in a reverse direction so as to be disengaged from the housing 61, the case electrode of the batteries 63 are electrically connected to the knob 66 only. The knob 66 is not electrically connected to the housing 61 and the tube 10 such that the light element 21 is turned off at this moment. The bottom end of the writing element 30 may be moved outward of the light element 21 when the knob 66 and the housing 61 are depressed inward of the tube 10.

Accordingly, the writing instrument in accordance with the present invention includes a light element that may be controlled to emit light for lighting purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A writing instrument comprising:

a tube including an upper portion and including a lower portion, a cap secured to said lower portion of said tube, a light element engaged in said cap and including a first electrode and a second electrode, a writing element slidably engaged in said tube, a pipe slidably engaged in said tube and including a lower portion engaged with said writing element and including an upper portion, a barrel secured in said tube, a housing slidably engaged in said upper portion of said tube and electrically connecting to said tube, a first cable for electrically connecting to said tube to said first electrode of said light element, an insulating sleeve engaged in said housing, at least one battery engaged in said insulating sleeve and including a case electrode and a center electrode, a knob threadedly engaged on top of said insulating sleeve, means for electrically connecting said knob to said case electrode of said battery, means for electrically connecting said center electrode to said pipe and said writing element, a second cable for electrically connecting said writing element to said second electrode of said light element, and a circuit board engaged in said cap and including an outer peripheral portion and including an orifice having an inner peripheral surface, said first cable electrically connecting said first electrode of said light element to said outer peripheral portion of said circuit board, said second cable electrically connecting said second electrode of said light element to said inner peripheral surface, and said writing element being engaged through said orifice of said circuit board for electrically and slidably contacting with said second cable, and said light element being energized when said knob is rotated relative to said insulating sleeve to engage with said housing.

* * * * *